United States Patent [19]

Ohiba et al.

[11] Patent Number: 4,780,022

[45] Date of Patent: Oct. 25, 1988

[54] ROAD SURFACE LAYER REPRODUCING APPARATUS

[75] Inventors: Tatsuhiko Ohiba, Kawaguchi; Ken-ichi Igarashi, Kohnosu, both of Japan

[73] Assignee: Taisei Road Construction Company, Ltd., Tokyo, Japan

[21] Appl. No.: 100,711

[22] Filed: Sep. 24, 1987

[30] Foreign Application Priority Data

Dec. 25, 1986 [JP] Japan ..... 61-315878

[51] Int. Cl.[4] ..... E01C 23/12; E01C 19/18

[52] U.S. Cl. ..... 404/90; 404/92; 404/110; 404/84

[58] Field of Search ..... 404/84, 90–92, 404/95, 108–111

[56] References Cited

U.S. PATENT DOCUMENTS

| | | | |
|---|---|---|---|
| 4,139,318 | 2/1979 | Jakob et al. | 404/84 X |
| 4,317,642 | 3/1982 | Wirtgen | 404/91 X |
| 4,453,856 | 6/1984 | Chiostri et al. | 404/92 X |
| 4,473,320 | 9/1984 | Register | 404/92 X |
| 4,534,674 | 8/1985 | Cutler | 404/95 X |
| 4,676,688 | 6/1987 | Cavadot | 404/91 |
| 4,682,909 | 7/1987 | Mihara | 404/95 X |

*Primary Examiner*—Stephen J. Novosad
*Assistant Examiner*—John F. Letchford
*Attorney, Agent, or Firm*—Cushman, Darby & Cushman

[57] ABSTRACT

Disclosed is a road surface layer reproducing apparatus which comprises a mixture hopper, a scarifier, and a mixer means including a first mixer of single-shaft rotor system and a second mixer of twin-shaft rotor system.

This apparatus is characteristic of a mixture hopper swingable laterally around its hopper supporting shaft, a sacrifier whose claws are so loosely fitted that the tip ends of the claws can follow up the contour of a road being remedied, a first mixer provided with a single-shaft rotor with a depth-measuring device for controlling the depth of penetration of the rotor into the asphalt of the road and mounted with screws for forming a windrow of an asphalt mixture to the center of the main body of the apparatus and a second mixer provided with parallel mounted twin-rotors which is vertically movable by a three-point supporting mechanism.

1 Claim, 14 Drawing Sheets

ROAD SURFACE LAYER REPRODUCING APPARATUS

BACKGROUND OF THE INVENTION

1. Field of the Invention

The present invention relates to a road surface layer reproducing apparatus and, more particularly, to a road surface layer reproducing apparatus which is adapted to reproduce for remedy the upper surface of a road paved with asphalt while it is being caused to travel.

2. Description of the Prior Art

Conventionally, a road surface which is paved with asphalt was generally reproduced for remedy through execution of the following steps. First of all, the paved road surface is heated. Then, it is scarified to a depth by means of a scarifier, and a softening agent is scattered on the road surface layer thus scarified. Thereafter, the resulting road surface layer is stirred by means of rotors, at which time a new asphalt mixture is added as the necessity arises. The road surface layer, thereafter, is spread and levelled by screw spreaders and then is tamped by screeds, followed by a final step in which the resulting surface is rolled. Of these reproducing steps, the heating step and the rolling step are carried out by an automotive road-surface heater vehicle and a road roller, respectively, while, on the other hand, the intermediate steps are carried out by use of various devices concerned which are incorporated in a road surface layer reproducing apparatus involved. This road surface layer reproducing apparatus is in the form of an automotive vehicle and generally is constructed such that at a lower part of the automotive vehicle, a new mixture hooper, a scarifier, a rotor, a screw spreader and a screed are disposed sequentially in that order from a front side of the vehicle so as to serve their respective use purposes.

However, the above-mentioned prior art road surface layer reproducing apparatus has the following problems.

(1) The hopper has an opening at its underside, beneath which is disposed a bar feeder so as to convey a mixture received therein to a rearward position of the vehicle body, a frontward part of the hopper being able to be vertically swung about a base end portion of a hopper-supporting arm. In the prior art apparatus, however, the pieces of the mixture which have attached onto side walls of the hopper can not automatically be caused to drop but are manually scratched down. Thus, an unnecessary labour is required to be used for such purpose. In addition, an asphalt mixture often fails to be equally carried rearwardly of the vehicle.

(2) Although the scarifier can be vertically raised and lowered as a whole, its claws can not be vertically moved for each block in such a manner as to follow up the surface of a road involved. As a result, where the road surface is not flat but has convexities and concavities (which are created as a result of, for example, rutting), the apparatus fails to scarify the road surface to a uniform depth.

(3) Since the rotor is of single-shaft type, it fails to sufficiently stir the scarified surface layer when the scarified depth is large. This makes it difficult to effect a homogeneous reproduction of the surface layer.

(4) Further, a certain old type of road surface layer reproducing apparatus has a rotor system wherein mixing is effected with the use of two-shaft rotors (connceted vertically in series) in the advancing direction of the vehicle. However, where the reproduction depth is small, such vertical type of mixer fails to provide a sufficiently high mixability on account of deficiency in quantity of the materials to be mixed. Conversely, where the reproduction depth is large, the mixer fails to process the full reproduction depth because of excess in quantity of such materials. Further, the surface of the scarified layer is exposed, at both end portions of the vehicle, to the open air and in consequence is cooled. This obstructs the adherence of the reproduction layer to a previous pavement located under the same. This becomes a cause of exfoliation of the former from the latter.

SUMMARY OF THE INVENTION

In view of the above, the object of the present invention is to provide a road surface layer reproducing apparatus with a multi-shaft rotor system which solves the above-mentioned problems arising from the prior art, and in which the hopper can be caused to vibrate in the lateral direction of the apparatus body; and the scarifier claws can be adjusted for each block to any given vertical position.

To attain the above object, according to the present invention, there is provided a road surface layer reproducing apparatus in the form of an automotive vehicle comprising an automotive main frame-like body, a mixture hopper at its front side of the main body, and a scarifier and mixers at positions beneath the main body, said mixture hopper being supported by a hopper supporting shaft laid on the main body in the longitudinal direction thereof while it is kept horizontal, and being made laterally swingable about the hopper supporting shaft, said scarifier having claws mounted thereon via fittings respectively, and being disposed in a vertical posture in a state wherein each fitting has its pin inserted into a pin hole formed in an upper end portion of the corresponding claw, so that lower ends of the claws may follow up the contour of a road to be remedied while the corresponding fittings are vertically moved, said mixer including a first and a second mixer which are disposed in such a manner as to intersect the advancing direction of the main body at right angles thereto, said first mixer being constructed in the form of a single-shaft rotor and being arranged such that its depth of penetration into a previous pavement of the road is adjusted to a predetermined value by a depth measuring device for sensing a surface of the pavement and thereby controlling the depth of penetration, said first mixer being adapted to move the mixture toward a position corresponding to a central part of the main body by means of screws mounted on an outer peripheral surface of the rotor, to thereby form a windrow of the mixture over which is dropped a bituminous mixture having been transferred rearwardly of the main body from the hopper by way of a bar feeder, said second mixer being located at a position succeeding to the first mixer and being constructed in the form of a twin-shaft rotor system and made vertically movable by a three-point supporting mechanism, said second mixer being adapted to mix together the windrow and the bituminous mixture as dropped thereover.

According to the present invention, a new asphalt mixture is received beforehand in the mixture hopper and is rearwardly fed, as the necessity arises, by the bar feeder. In this case, since the hopper can be swung, widthwise of the main body, about the hopper-supporting shaft, the pieces of the mixture are allowed to drop through vibrations even when they adhere onto inner wall surfaces of the hopper, with the result that they can smoothly be fed rearwardly at uniform rate by means of the bar feeder. Where the surface of the road to be remedied has irregularities, it is rare that six wheels of the apparatus have their lower ends located on the same plane. Namely, although the pneumatic roller wheels are automatically adjusted and can thus be brought into contact with the surface of the road, the wheels beneath the hopper are less likely to be so adjusted. For this reason, the hopper is made inclinable laterally or widthwise of the main body.

According to the present invention, the scarifier is vertically disposed in a manner that the pin hole formed in the upper end portion of each claw is idly inserted over the pin of the corresponding fitting. Therefore, even when the fitting is vertically so raised as to be vertically inclined, the corresponding claw is so supported as to stand in a vertical posture. Accordingly, the lower end of the claw can be made to follow up the irregular surface of the road. This makes it possbile to scarify the irregular surface of the road (created as a result of, for example, rutting) to a uniform depth. This means that any concave and convex surface of the road to be remedied can be scarified to a uniform depth. The mixer is of parallel mounted multi-shaft rotor system. Therefore, even at the time of deeply scarifying the road surface and mixing the resultant mixture and the newly added asphalt mixture with each other, it enables such mixing to be smoothly effected to a satisfactory extent. On the other hand, the mixer is interlocked with a depth measuring device. Therefore, the depth of penetration of the mixer into a previous pavement can be maintained at a predetermined constant value.

BRIEF DESCRIPTION OF THE DRAWINGS

An embodiment of the present invention is illustrated in the drawings in which.

DESCRIPTION OF THE PREFERRED EMBODIMENT

Figure 1:
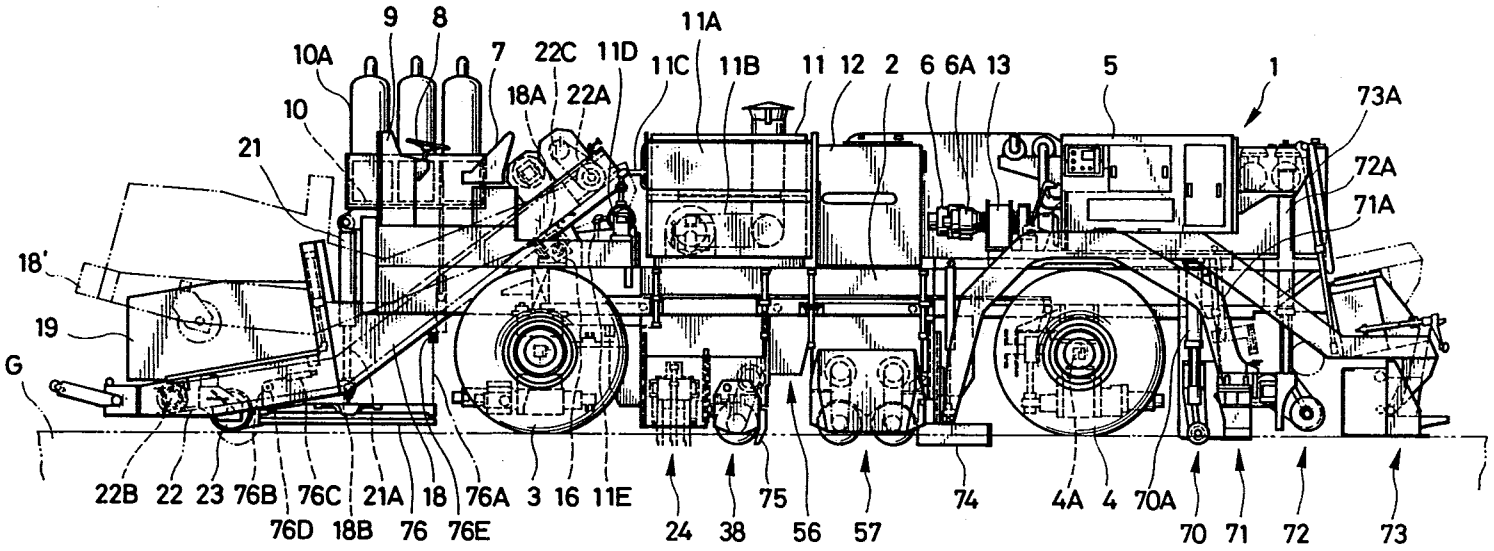
FIG. 1 is a side view of a road surface layer reproducing apparatus.
Figure 2:
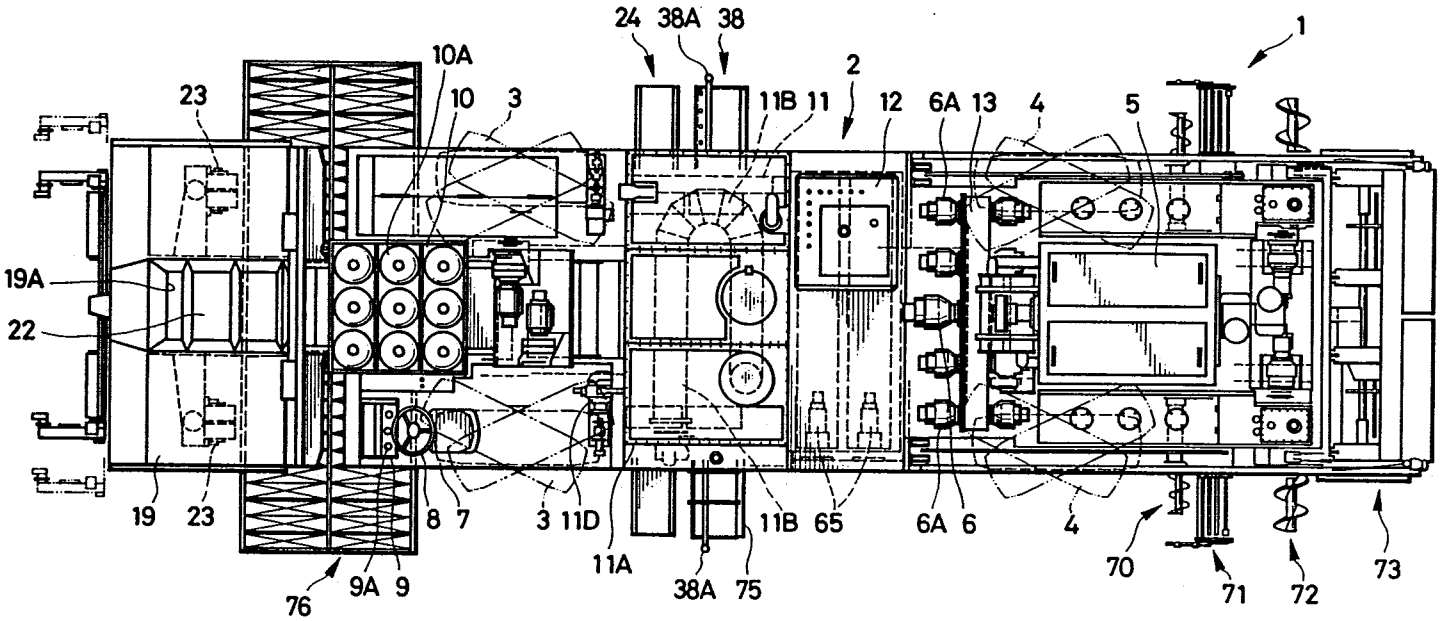
FIG. 2 is a plan view thereof.

A road surface layer reproducing apparatus according to an embodiment of the present invention will now be described with reference to the drawings. FIG. 1 is a side view of a road surface layer reproducing apparatus, while FIG. 2 is a plan view thereof. The outline of the construction of the road surface layer reproducing apparatus will first be described below with the use of FIGS. 1 and 2.

The road surface layer reproducing apparatus 1 has front wheels 3, 3 and rear wheels 4, 4 which are disposed beneath a main frame-like body 2 of the apparatus in the same manner as in the case of an ordinary automobile. It also has an engine 5 which is loaded on the main body 2, and a hydraulic pump 6 which is driven by the engine 5. It is driven while a working fluid for operating the hydraulic pump 6 is used as a power generating source. The front wheels 3, 3 and the rear wheels 4, 4 are steerable by operation of a steering wheel 8 at an operator's seat 7 provided on the main body 2.

On the main body 2, the operator's seat 7 is disposed at the front/left side thereof. Various meters 9A for automatically and manually operating their corresponding devices involved are caused to appear, or exposed, in front of the operator's seat 7. An operating board 9 in which a microcomputer is contained, also, is disposed in front of the operator's seat 7. At the right side of the operator's seat 7 as viewed from a rear side of the main body 2, a gas storage section 10 is provided, in which gas cylinders 10A are loaded, the gas cylinders 10A each having received therein a fuel for heating a heating panel 76 as later described.

On a substantially central portion of the main body 2 there is disposed an additive heater 11, at the back of which there is disposed an additive tank 12. This tank 12 has received therein an ordinary softening agent which is to be added over the scarified pieces of that surface layer G of a previously asphalt-paved road which has been scarified by a scarifier 24. The softening agent is fed to the additive heater 11 by way of a pipe not shown and then is heated by that heater 11 up to a temperature of approximately 90° and then is ejected over a portion of the road surface in immediate front of a first mixer 38 as later described. The heater 11 is of an indirect heating system wherein a flue 11B is provided under a tank 11A. A pipe 11C is allowed to extend outwardly from the tank 11A and is connected to an ejection pump 11D disposed on the main body 2. From the ejection pump 11D there is extended a feeding pipe 11E up to a frame body of the first mixer 38.

The engine 5 is disposed on a rear portion of the main body 2. In front of the engine 5 there is dipsosed a hydraulic pump unit 13 adapted to be driven by the engine 5 in such a manner that the pump unit 13 is contiguous to the latter 5, the pump unit 13 being equipped with a plurality of hydraulic pump 6, 6A, ---, which are connected to various hydraulic motors and hydraulic cylinders so as to feed thereto the working fluids concerned therewith by way of hydraulic circuits not shown.

Figure 4:
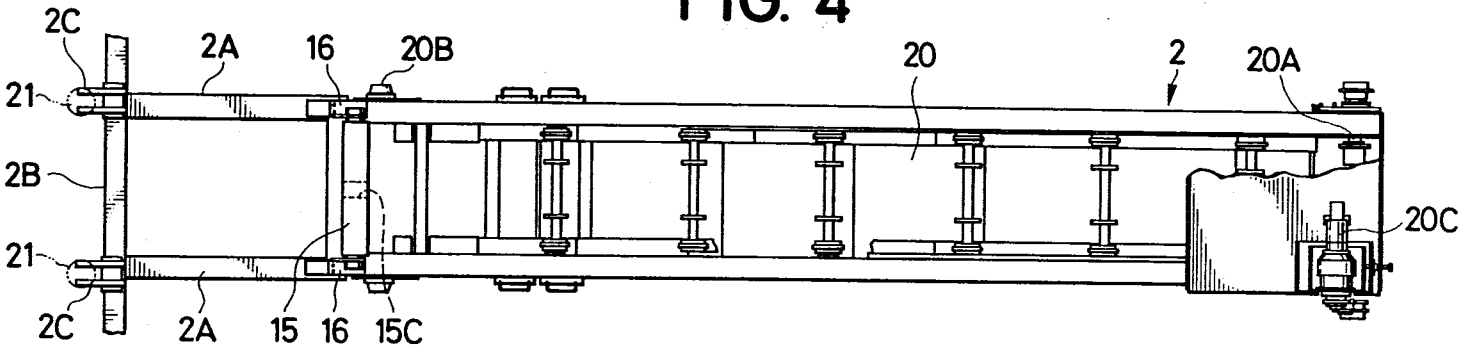
FIG. 4 is a plan view of the main body.

The main body 2 includes longitudinal frame members 2A, 2A which, as shown in FIG. 4, are arranged in parallel when seen in plan view and at the frontward ends of which there is disposed a front frame member 2B in such a manner that it is perpendicular to the longitudinal frame members. Provided on the front frame member 2B at symmetrical positions corresponding to the points of intersection between the member 2B and the members 2A, 2A, there are provided cylinder fixing portions, respectively, from which there are suspended raising/lowering cylinders 21 for adjusting the vertical level of a hopper 19 as later described, respectively.

Figure 3:
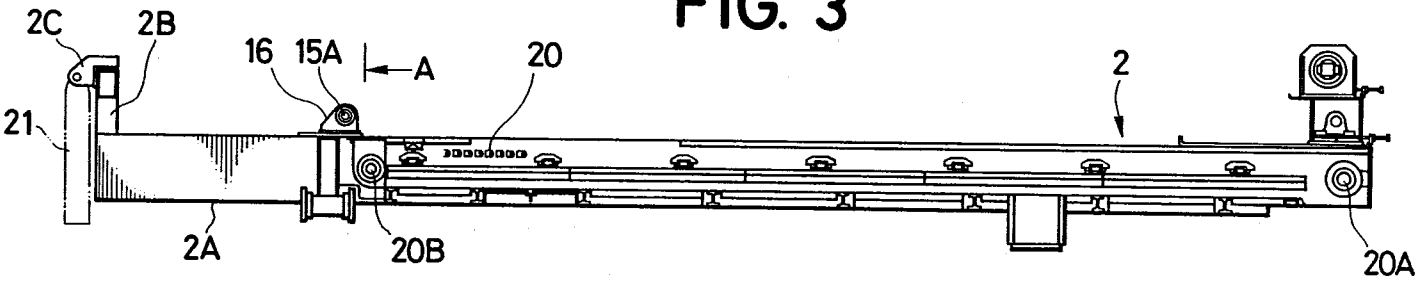
FIG. 3 is a side view of a main body of the road surface layer reproducing apparatus.
Figure 5:
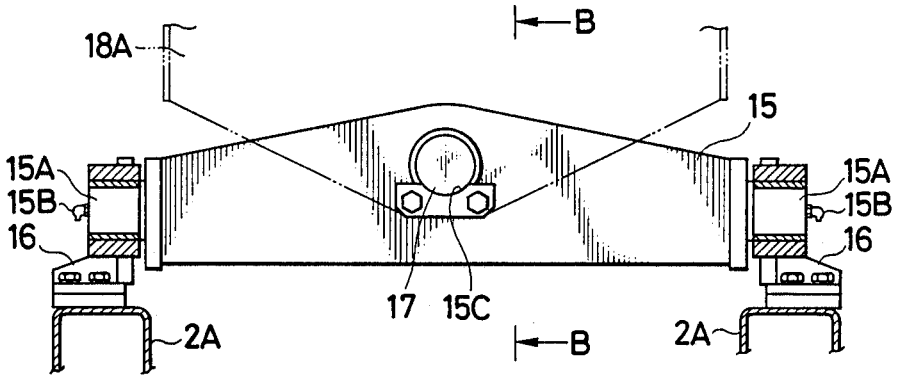
FIG. 5 is a view taken from a direction indicated by an arrow A of FIG. 3.
Figure 6:
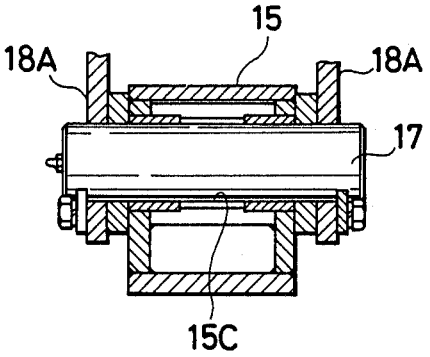
FIG. 6 is a view taken from a direction indicated by arrows B of FIG. 5.

At the positions of the longitudinal frame members 2A, 2A which are rearwardly spaced by a specified distance from the frontward ends thereof a hopper mounting seat 15 is attached via bearing seats 16, 16. As shown in FIG. 5 being a view taken from a direction indicated by an arrow A of FIG. 3 as well as FIG. 6 being a view taken from a direction indicated by arrows B—B of FIG. 5, the hopper mounting seat 15 consists of a laterally elongate frame member and has supporting shafts, 15A, 15A at its longitudinal ends, respectively, the supporting shafts 15A, 15A being supported by means of the bearing seats 16, 16 which are respectively disposed on the longitudinal frame members 2A, 2A. It is to be noted that reference numerals 15B, 15B denote grease nipples, respectively. The longitudinal central part of the hopper mounting seat 15 is formed with a shaft insertion hole 15C which is allowed to direct in the longitudinal direction of the main body 2, and into which is fitted a hopper supporting shaft 17, the ends of which are allowed to protrude outwards. The ends of the hopper supporting shaft 17 have secured thereto, respectively, a pair of supporting plates 18A, 18A secured to the undersides of a pair of hopper supporting arm 18 as later described. Thus, the mixture hopper 19 secured to the hopper supporting arms 18 is swingable, laterally of the main body 2, about the hopper supporting shaft 17 by operation of the cylinders 21. At the same time, a frontward end of the mixture hopper 19 is swingable vertically about the supporting shafts 15A, 15A of the hopper mounting seat 15.

Between respective opposing sides of the longitudinal frame members 2A, 2A and at a position located rearwardly of the bearing seats 16, 16, there is disposed a bar feeder 20, which is of a conventional type. That is, a belt conveyor of the bar feeder 20 is stretched over, and between, a drive shaft 20A and a driven shaft 20B, and is cuased to revolve from a frontward to a rearward side by means of a driver 20C, so as to feed rearwards the new mixture material loaded in the hopper 19 and having been brought thereonto by means of a bar feeder 22, as later described of the hopper.

The two hopper supporting arms 18 are disposed, as one pair and in parallel to each other, in the longitudinal direction of the longitudinal frame members 2A, 2A. As shown in FIG. 1 in which their side face is illustrated, they are inclined at their base end portions and are made substantially horizontal at their frontward half portions, the base end portions having the supporting plates 18A, 18A secured to their undersides. The raising/lowering cylinders 21 suspended from the front frame member 2B have piston rods 21A which are directed downwards, and lower ends of which are connected to mounting portions 18B provided on the undersides of the hopper supporting arms 18, respectively. As the piston rods 21A make their raising/lowering operation, the hopper supporting arms 18 can have their frontward portions lowered or raised about the supporting shafts 15A, 15A of the mounting seat 15, up to a position indicated by a phantom line 18' of FIG. 1.

Between respective opposing sides of the hopper supporting arms 18 there is disposed the above-mentioned bar feeder 22. More specifically, reference numeral 22A denotes a drive shaft, reference numeral 22B denotes a driven shaft, and reference numeral 22C denotes a drive means. The mixture material is fed from below to above by means of the bar feeder 22 and, after having arrived at the top, is allowed to drop onto the bar feeder 20 in the longitudinal frame members. On the frontward half portions of the hopper supporting arms 18 there is disposed the mixture hopper 19 with a discharge port 19A (see FIG. 2) thereof being directed toward the bar feeder 22. Within the mixture hopper 19 there is received a new asphalt mixture which has been conveyed thereto by, for example, a dump truck. Below the front portions of the hopper supporting arms 18 there are disposed a pair of supporting wheels 23, 23 which serve to support the hopper 19.

Under the main body 2 and between the front wheels 3 and the rear wheels 4 there are disposed sequentially from the front side to the rear side the scarifier 24, the first mixer 38 and a second mixer 57, respective constructions of which will now be described in detail.

Figure 7:
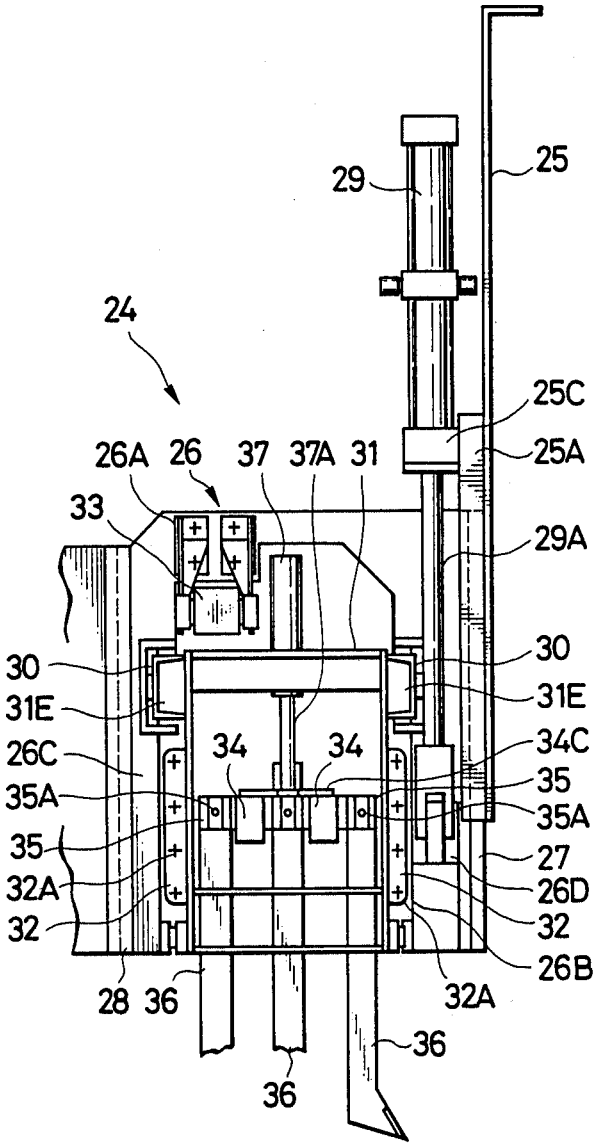
FIG. 7 is a side view of an essential part of a scarifier.
Figure 8:
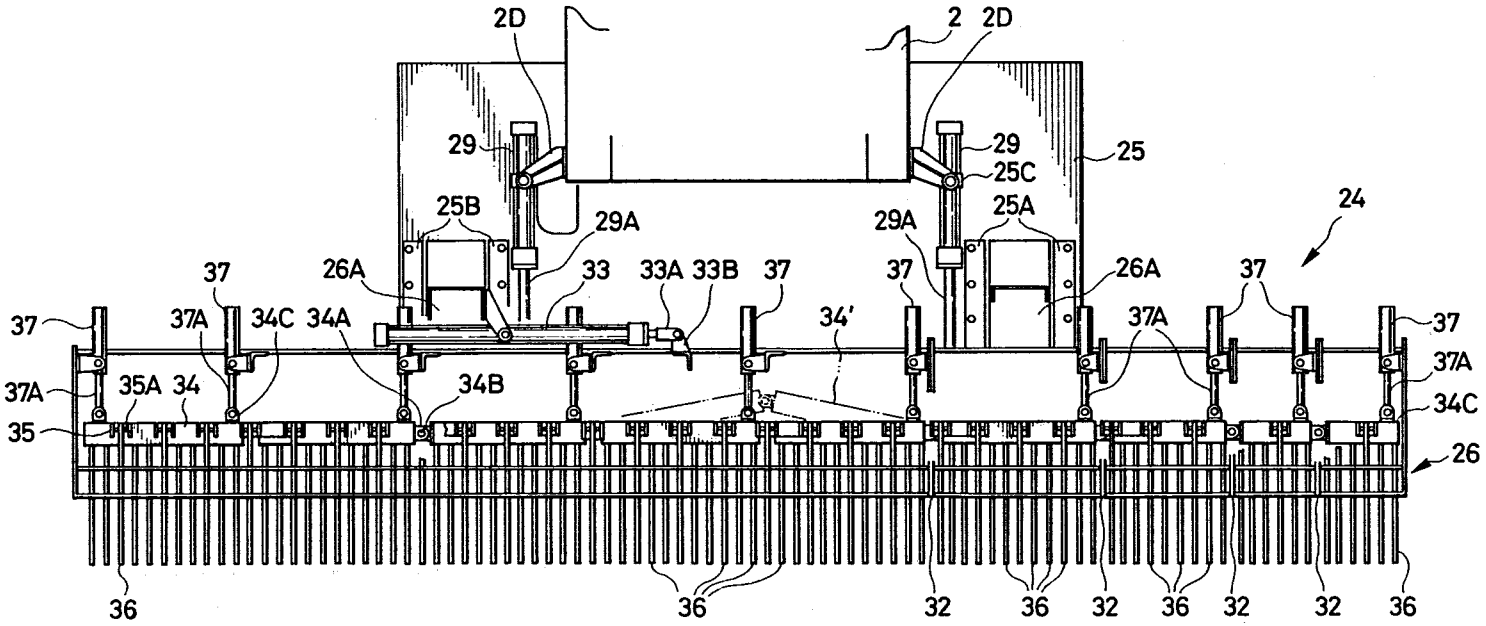
FIG. 8 is a front view of an essential part of the scarifier.
Figure 9:
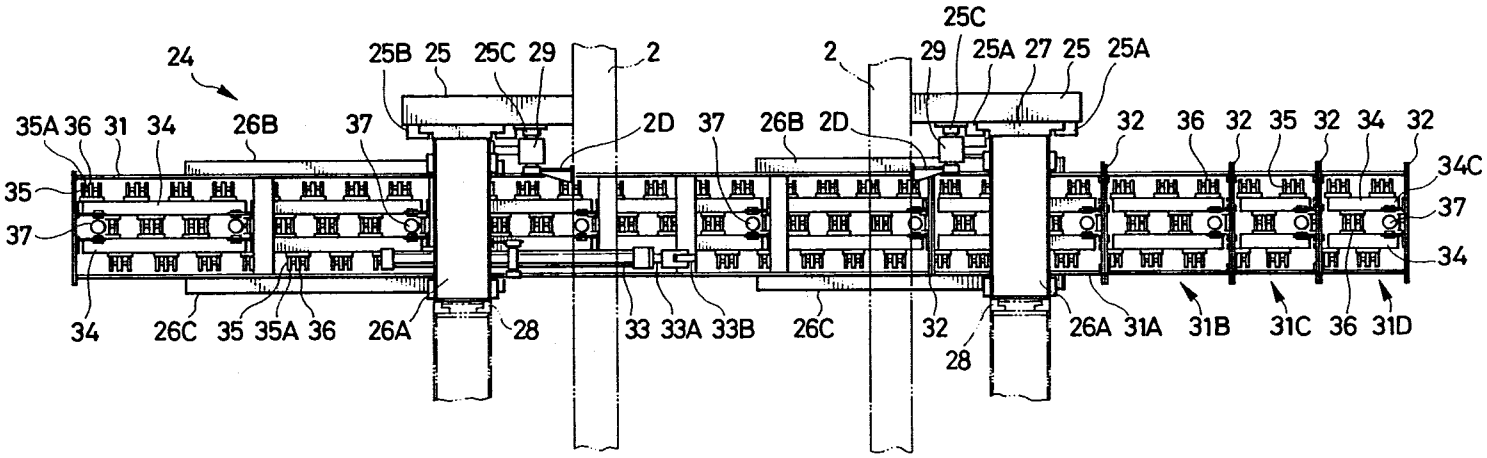
FIG. 9 is a plan view of the scarifier.

As shown in FIG. 7 being a detailed side view of the scarifier, FIG. 8 being a detailed rear view thereof and FIG. 9 being a detailed plan view thereof, the scarifier 24 is arranged such that a mounting plate 25 therefor is disposed beneath the main frame-like body 2 vertically and perpendicularly with respect to the longitudinal direction of the main body 2, the mounting plate 25 having pairs of guiding members 25A, 25A and 25B, 25B disposed at its side edge portions with the guiding members of one pair being located at their corresponding side edge portion, the paired guiding members 25A, 25A and 25B, 25B having respectively fitted thereinto a pair of guide portions 27, 27 provided on a frame 26 as later described in such a manner that the guide portions 27, 27 are vertically slidable along their corresponding guiding members.

The frame 26 includes a pair of upper frame members 26A, 26A which are each elongate in the longitudinal direction of the main frame-like body 2 and which are disposed separately from each other, the pair of upper frame members 26A, 26A being each provided, beneath its longitudinal ends, with front and back frame members (26B, 26C) and (26B, 26C) in such a manner that the front and back frame members are in parallel to each other and are held in vertical posture. The guide portions 27, 27 are provided in a state wherein they are held in vertical posture, immediately before the front frame members 26B, 26B and at the ends of the upper frame members 26A, 26A. On the other hand, in the portions of the back frame members 26C, 26C at that side of the upper frame members 26A, 26A which is opposite to that at which the guide portions 27, 27 are located, there are formed guiding portions 28, 28 for the first mixer as later described in such a manner that those guiding portions 28, 28 come to be elongated in the vertical direction.

Raising/lowering cylinders 29, 29 are mounted on the mounting plate 25 via supporting portions 25C and 2D in such a manner that they are suspended from the mounting plate 25. Lower ends of piston rods 29A, 29A of the raising/lowering cylinders 29, 29 are connected to mounting portions 26D (see FIG. 7) of the frame 26, whereby the frame 26 can be raised and lowered by operation of the raising/lowering cylinders 29, 29.

In respective upper opposing faces of the front frame members 26B and the back frame members 26C there are disposed guiding rails 30, 30, respectively, the cross section of which are shaped like a horizontally thrown U, in such a manner that their concave portions oppose each other. Into the guiding rails 30, 30 there are slidably fitted respective guide portions 31E, 31E of a small frame 31, whereby the small frame 31 and other small frames 31A, 31B, 31C and 31D are suspended therefrom.

The small frame 31 has a length which is in conformity with the width of the vehicle body. However, the small frames 31A, 31B, 31C and 31D of suitable length are sequentially joined to the small frame 31 in that order in order to enable the surface of a road involved to be scarified more widely than the breadth of the vehicle body. In the drawing, reference numerals 32, 32, --- each denote a junction between two adjacent of the small frames, which are connected to each other by being mutually fastened together by means of bolts 32A, 32A.

A cylinder 33 is mounted, while it is laid in horizontal posture, on the upper frame member 26A located above the small frame 31 in such a manner that the cylinder is directed in the longitudinal direction of the latter 31. The cylinder 33 has a piston rod 33A, a tip end portion of which is connected to a mounting portion 33B located above the small frame 31, whereby the small frame 31 can be longitudinally moved along the guide rails 30, 30. More specifically, in FIGS. 8 and 9, the cylinder 33 is maintained to be in a contracted state and therefore the small frame 31 is maintained to be biased toward the left side of the illustrations, at the right side of which the other small frames 31A, 31B, 31C and 31D are connected for supplementary purpose. That is to say, since these auxiliary small frames 31A to 31D are intended to be added so as to permit the scarifier width to be in conformity with the breadth of a road to be remedied, when some of such auxiliary small frames have been removed, the small frame 31 is moved by a specified length rightwardly of the illustration by expanding the cylinder 33, to as to make equal those portions of the small frames which prodrude from the breadthwise ends of the vehicle body, respectively.

The constituent members of each small frames 31, 31A, 31B, 31C or 31D are framed into a rectangular shape as viewed from above, and a pair of supporting bars 34, 34, --- are horizontally installed, while kept in suspension, at intermediate positions of the framed interior zone in such a manner that they extend in parallel to each other and in the longitudinal direction of the small frame. The supporting bars 34, 34 are made to have a specified length and are provided with connecting portions 34A, 34A at their portions opposing the adjacent supporting bars 34, 34, whereby one pair of supporting bars 34, 34 are disconnectably connected to another adjacent pair of supporting bars 34, 34 by means of bolts 34B, 34B, respectively.

On both sides of each supporting bar 34 or 34 there are disposed mounting means 35, 35, --- in such a manner that the devices on each side are spaced from each other by a specified distance in the longitudinal direction of the corresponding supporting bars 34, the mounting means 35, 35, --- being mounted with claws 36, 36, --- via pins 35A, 35A, --- in such a manner that the claws 36, 36, --- extend downwards. More specifically, the difference between the diameter of a pin hole formed in each claw and the diameter of the corresponding pin 35A, 35A, --- made great so that the claw 36, --- can be swung in the longitudinal direction of the pin 35A.

Figure 17:
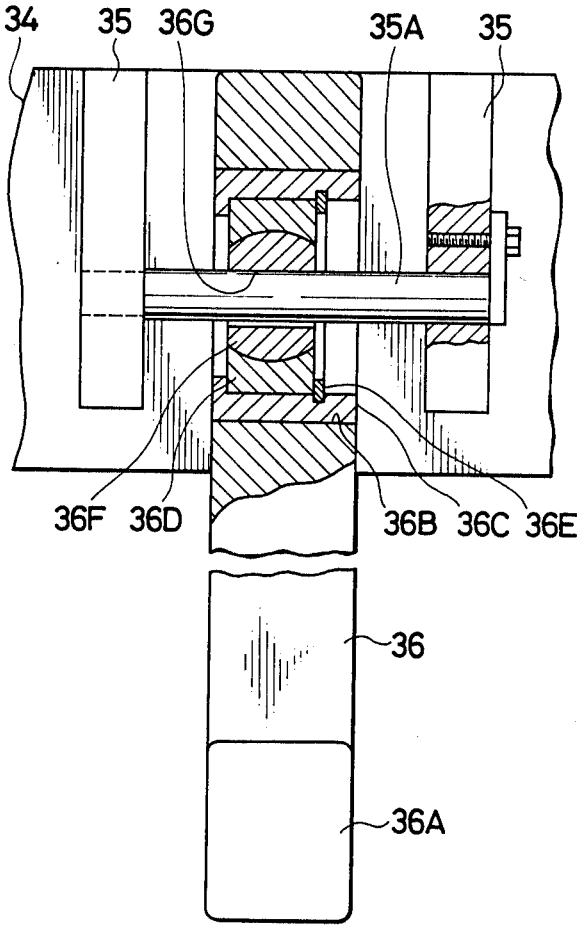
FIG. 17 is a front view showing a structure which supports claws of the scarifier.

As shown in FIG. 17 which shows a front view of its head portion, the claw 36 is provided, at the frontward portion of its lower end, with a scarifying bit 36A in such a manner that the latter projects from the corresponding claw. Further, the claw is formed, at its head portion, with a fitting hole 36B in such a manner as to pass through the head portion in the lateral direction thereof as viewed from the front side of the claw, the fitting hole 36B being fitted thereinto with a bearing case 36C in such a manner that the latter is fixedly held in place in the fitting hole 36B. The bearing case 36C has a fitting hole into which is fitted a bearing outer ring 36D which is fixedly held in place by a snap ring 36E. The bearing outer ring 36D has rotatably fitted therein an inner race 36F having a spherical sliding surface, the inner race 36F having a pin hole 36G through which the pin 35A is passed, the pin 35A being fixed to the corresponding mounting means 35, 35, --- , whereby the corresponding claw 36 is suspended therefrom. The difference between the outer diameter of the pin 35A and the inner diameter of the pin hole 36G is made large, whereby the claw 36 can not only be slid but also swung in the longitudinal direction of the pin 35A.

On the tops of the supporting bar 34, 34, --- are fixedly mounted mounting plates 34C, 34C, ---, respectively, above which there are vertically provided adjusting cylinders 37, 37, --- which have piston rods 37A, 37A, ---, lower ends of which are connected to the mounting plates 34C, 34C, ---, respectively. Each adjusting cylinder 37, 37, --- can independently be operated. It permits its corresponding supporting bars 34, 34, --- to be maintained to be laid in its horizontal posture as shown in FIG. 8, and the adjusting cylinders 37, 37, --- also permit the end portions of some of the supporting bars 34 to be vertically moved to have their corresponding bars inclined from their horizontal level. That is, even when the surface of a road to be remedied is corrugated crosswise due to, for example, rutting the supporting bars 34, 34, --- are so inclined as to conform with such corrugated contour of the road, thereby enabling the tips of the claws 36, 36, --- vertically provided beneath them to follow up the configuration of the road surface. This makes it possible to permit the tip ends of the claws 36, 36, --- to be pierced into the road surface by the same depth, that is to say, the scarifier can scarify the road surface at any place thereof to the same depth. In this case, since the diameter of the pin 35A is greatly differentiated from that of the pin hole 36G, the corresponding claw 36 --- can be kept in its vertical posture even when the corresponding supporting bar 34 --- is inclined.

With its described construction, the scarifier 24 normally is raised by operation of the raising/lowering cylinders 29, 29 and, in this condition wherein the scarifier 24 is elevated, the road surface layer reproducing apparatus is allowed to run. At the construction site, however, the raising/lowering cylinders 29, 29 are lowered to cause the claws 36 to be so lowered as to permit their tip ends to approach the surface of the road. Next, each adjusting cylinder 37, 37 adjusts the ends of its corresponding claws so as to permit them to come close to and follow up the contour of the road while they are brought into conformity with the configuration of the latter to the largest possible extent. Thereafter, the raising/lowering cylinders are further lowered at the time when the remedying operation is started, so as to cause the claw ends to be pierced into the road surface by a specified depth. As the main frame-like body advances, the surface of the road is scarified to the depth by which the tip portions of the claws are penetrated . The cylinders 29 ---, 33 ---, and 37 --- are connected, by means of pipes not shown, to the hydraulic pumps installed on the main body, the pipes being provided, at their intermediate portions, with electromagnetic control valves which are electrically connected to a computer contained within the operation board 9 and thus are automatically controlled in accordance with a specified program.

Figure 10:
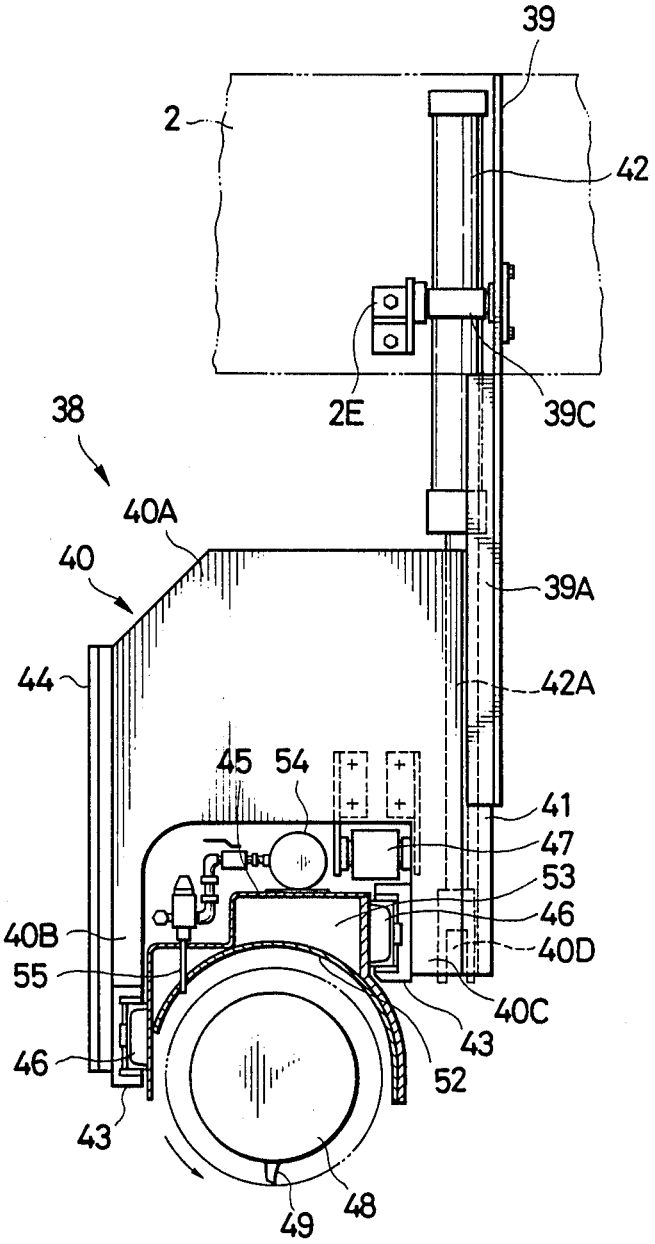
FIG. 10 is a side view of an essential part of a first mixer.

Next, the first mixer 38 will be described below with reference to its side view, its rear view and its plan view respectively shwon in FIGS. 10, 11 and 12, the right side of the illustration 10 indicating the rearward direction of the main body 2.

A supporting plate 39 is vertically suspended from both sides of the main body 2. On the end portions, on the front side, of the supporting plate 39 there are vertically provided a pair of guiding means (39A, 39A) and (39B, 39B) into which respective guide portions 41, 41 of a pair of frames 40 are fitted so that the guide portions 41, 41 can be raised and lowered along their corresponding guiding means, respectively. At the upper frontward portions of the supporting plate 39 which are near to the portions of intersection between the supporting plate 39 and the two members of the main frame-like body 2, a pair of raising/lowering cylinders 42, 42 are vertically provided via fittings 39C, 39C, 2E, 2E.

The frames 40 have upper frame members 40A in such a manner that the latter extends in the longitudinal direction of the main body 2, the upper frame members 40A being formed, at their front and back portions, with vertically extending portions 40B, 40C, respectively, the upper frame members 40A being formed, at their rear faces, with the guide portions 41, respectively, and being also formed, at their front faces, with guide portions 44, 44 adapted to be engaged with the guiding portions 28, 28 of the scarifier 24, respectively.

On respective lower opposing faces of the vertically extending portions 40B, 40C, there are horizontally disposed guiding rails 43, 43, --- in such a manner that they extend in a direction perpendicular to the longitudinal direction of the main body 2, while the guiding rails 43 corresponding to the front vertically extending portions 40B are located at a level lower than that of the guiding rails 43 corresponding to the vertically extending portions 40C. The guiding rails 43, 43 are shaped, in cross section, like substantial horizontally-thrown Us whose concaved portions are directed in directions in which both can oppose each other.

The piston rods 42A, 42A of the raising/lowering cylinders 42, 42 are connected at their lower end to mounting portions 40D provided on the rear vertically extending portions 40C of the frames 40, respectively, whereby the frames 40 can be raised and lowered by operation of the raising/lowering cylinders 42, 42.

Between respective mutually opposing faces of the guiding rails 43, 43 there is disposed a rotor supporting frame 45 which is formed into an elongate box-like configuration having an opening at its lower end, in such a manner that its length intersects the main frame-like body at right angles thereto, said rotor supporting frame 45 being provided, outside its front and back faces, with guide portions 46, 46 in such a manner that these portions are horizontally laid and extend in the lateral direction, the guide portions 46, 46 being slidably fitted into the concave portions of the guiding rails 43, 43.

Beneath the upper frame member 40A there is horizontally disposed a cylinder 47 in such a manner that the latter extend in the longitudinal direction of the rotor supporting frame 45, the cylinder 47 having a piston rod 47A a tip end of which is connected to a fixing portion 45D provided on an upper end portion of the rotor supporting frame 45, whereby this frame 45 can be caused to slide along the guiding rails 43, 43 by the expansion and contraction of the cylinder 47.

On one longitudinal end of the rotor supporting fram 45 there is provided a connecting portion 45C by way of which auxiliary rotor supporting frames 45A, 45B are connected to the frame 45. When it is desired to effect the mixing operation more widely than the breadth of the main body 2, those auxiliary rotor supporting frames 45A, 45B are supplementarily connected for the purpose of making the length of the mixer correspondingly greater. The construction of the auxiliary frames 45A, 45B is the same, as a whole, as that of the main frame 45. When the auxiliary rotor supporting frames 45A, 45B have been added, the cylinder 47 is operated for adjustment of frame length so as to permit the end portions of the resulting rotor supporting frame connection to be protruded by equal lengths from both sides of the main body 2 in corresponding relationship to the lenth of such resulting frame connection.

Rotors 48 have their shafts secured to the rotor supporting frames 45, 45A and 45B, and are provided, on their peripheral surfaces, with a plurality of bits 49. Through rotation of the rotor 48, the surface layer of the road having been scarified by means of the scarifier 24 is cut and broken into fine pieces and, at the same time, additives as later described are mixed into such scarified pieces. As shown in FIG. 11, at the longitudinal central part of the main rotor supporting frame 45 there is disposed a hydraulic motor 50 having an output shaft not shown which is connected to a mechanism in a mechanical transmission unit 51. This unit 51 is connected to a shaft portion not shown of the rotor 48, whereby the rotor 48 can be caused to rotate by driving the hydraulic motor 50. The auxiliary rotor supporting frames 45A, 45B also have similarly secured thereto rotors having shafts each of which is connected, at its ends, with the shafts of adjacent rotors via connectors and in series, so as to permit adjacent rotors to be jointly rotated.

At the upper zones of the framed interiors of the rotor supporting frames 45, 45A, 45B there are disposed arcuate heating plates 52, respectively. Between the heating plate 52 and upper part of the rotor supporting frame 45 located above the heating plate 52 there is defined a heating chamber 53, within which there is disposed a heater not shown which is capable of heating the heating plate 52 up to a temperature of 160° C. or more. More specifically, as the rotor 48 rotates, those scarified pavement pieces of the road surface layer involved are scratched up by the rotor bits 49 and then are allowed to drop while they experience their sliding contact with the heating plate 52. During this time period, the heating plate 52 heats such scarified pavement pieces to thereby prevent these pavement pieces from being cooled. This makes it possible to enhance the mixability of additives with respect to the pavement pieces. The auxiliary rotor supporting frames 45A, 45B also are constructed in the same manner as in the case of the frame 45. The rotor supporting frames 45, 45A, 45B are connected to one another via connecting portions 45C, which have connection faces. When use is made of a heater other than an electric heater, said connection faces are formed with through bores so as to permit the hot air in one heating chamber to be freely passed into another adjacent one.

Above the rotor supporting frame 45 there is disposed an additive feeding pipe 54 in such a manner that the latter extend in the longitudinal direction of the frame 45. From the additive feeding pipe 54 there are extended a plurality of nozzles 55 in such a manner that they project therefrom into the positions located in upper front of the rotor 48. On the main vehicle body 2 there is disposed an additive heating device 11, to which is connected an ejection pump 11D, from which is extended a delivery pipe 1E, which is connected to the additive feeding pipe 54. Whereby, the additive which has been heated by the additive heating device 11 is pressurized by the ejection pump 11D and then is ejected from the nozzles 55 over a road surface located in immediate front of the rotor 48. That is, the additive (softening agent) is ejected over those pavement pieces of the paved road surface layer which have been produced as a result of scarification performed by the scarifier 24, and then both the additive and the pavement pieces are mixed with each other. Also disposed above the auxiliary rotor supporting frames 45A, 45B are additive feeding pipes of small length, which, when those frames 45A, 45B have been connected to the main rotor supporting frame 45, are connected to the end of the additive feeding pipe 54 located thereabove by means of a connecting hose not shown so as to permit the additive to be fed into such additive feeding pipes of small length.

With the described construction, when the frames 40 are raised by contraction operation of the raising/lowering cylinders 42, they are caused to rise while their rear portions are slided along the guiding means (39A, 39A) and (39B, 39B) respectively and while their front portions are slided along the guiding portions 28, 28 located at the rear portions of the scarifier 24. In performing the remedy operation, the raising/lowering cylinders 42 are caused to make their expansion operations. This lowers the rotor 48, whereby its bits 49 are brought into contact with the surface of a road to be remedied. Simultaneously with the scarification made by the scarifier 24, the rotor 48 is further lowered by operation of the cylinders 42 so as to permit the tip ends of the bits 49 to be penetrated into the scarified road surface layer to the scarified depth of, for example, 3 cm or 5 cm. The bits 49 of the rotor 48 are arranged in the form of a screw, and the bits located at the left half portion of the rotor 48 as extended from the mechanical power-transmission unit 51 have their helical crest bit arrangement allowed to extend in a direction opposite to that in which the right helical crest bit arrangement is allowed to extend. Thus, the rotor 48 acts to bring the already scarified pavement pieces of the road surface layer involved from the widthwise ends of the rotor 48 toward the power-transmission unit 51 while it is rotated in a direction indicated by an arrow of FIG. 10 and while it stirs such pavement pieces. This aims to avoid the idle rotation of the rear wheels 4, 4 which might occur due to shortage of their contact pressure when they ride over the scarified pavement pieces.

Figure 11:
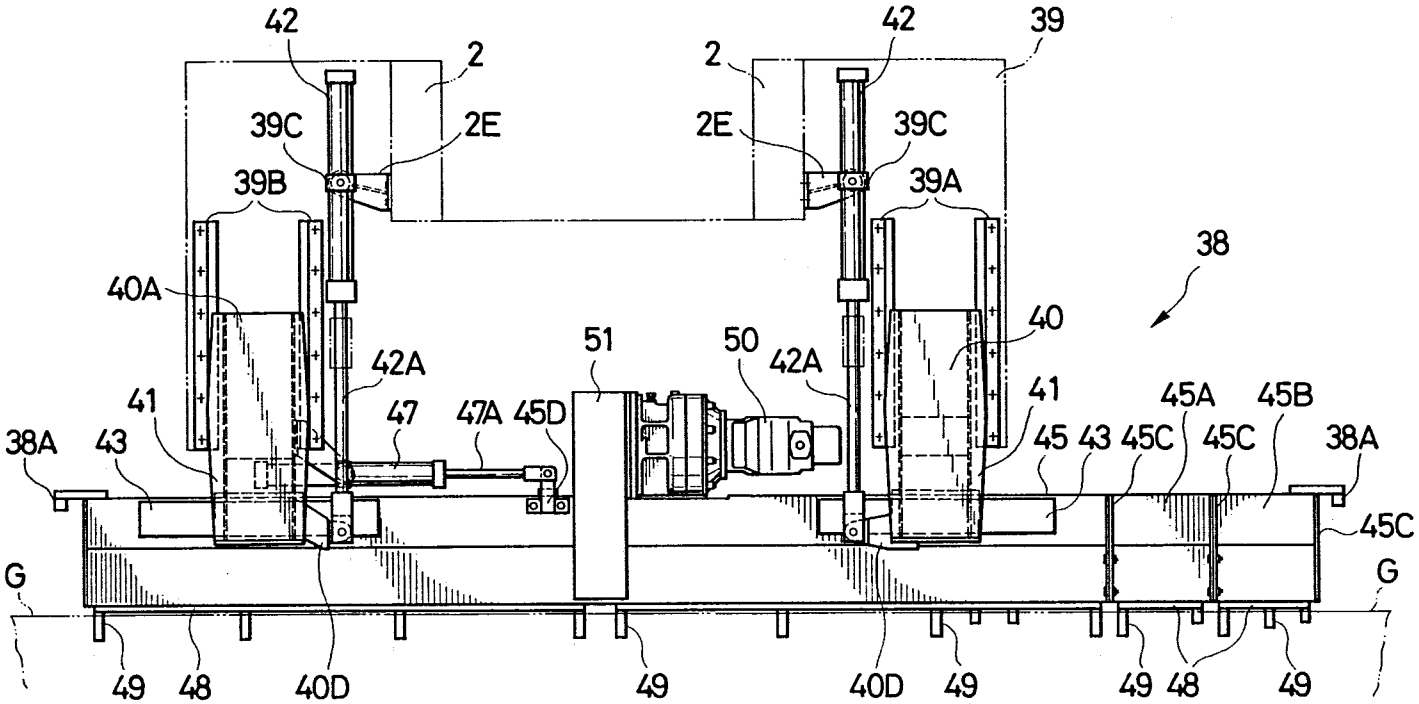
FIG. 11 is a rear view of an essential part of the first mixer.
Figure 12:
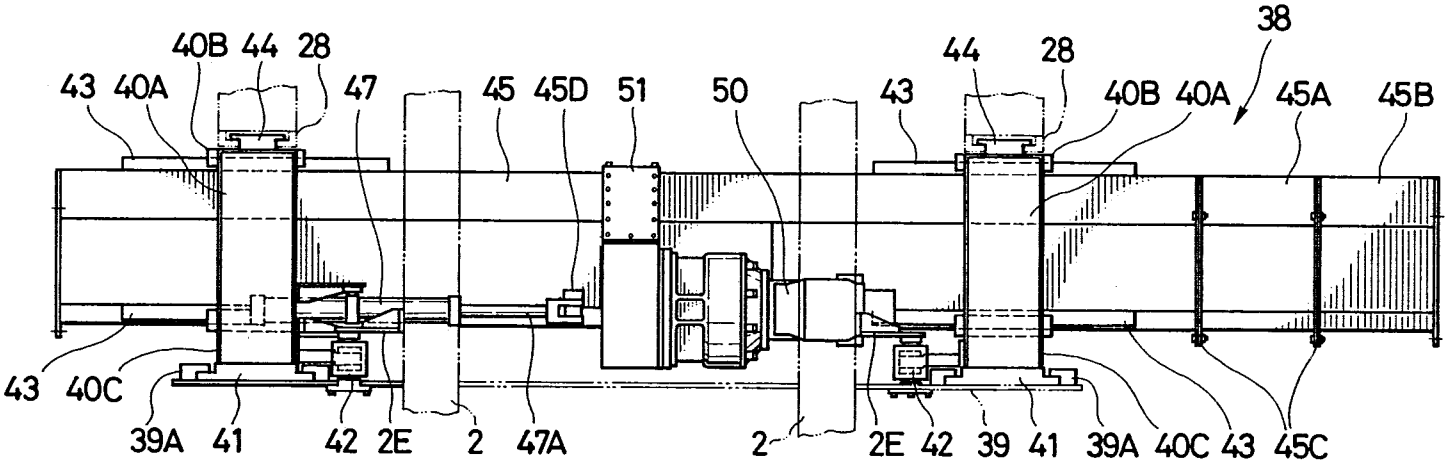
FIG. 12 is a plan view of the first mixer.

While the rotor supporting frame 45 can be raised or lowered by operation of the raising/lowering cylinders 42, the penetration depth of the rotor bits 49 --as measured from the surface G of the paved road is controlled by depth measuring devices 38A, 38A which are mounted on the rotor supporting frame 45 as shown in FIG. 11. More specifically, the depth measuring devices 38A, 38A generate ultrasonic waves over the road surface G to measure their own positional levels from the rate at which the ultrasonic waves as reflected are returned. Thus, the penetration depth of the rotor bits 49 is calculated by a microcomputer installed within the operation board 9 at the operator's seat 7, to thereby control the raising/lowering operations of the raising/-lowering cylinders 42, 42.

At the portion of the main frame-like body 2 which is located behind the first mixer 38 there is provided a mixture discharge port 56 in such a manner that that port extends in the lateral direction of the main body 2. This is for the purpose of causing a new asphalt mixture material loaded in the hopper 19, which has been conveyed up to the position involved, to drop in immediate front of the second mixer 57.

Figure 14:
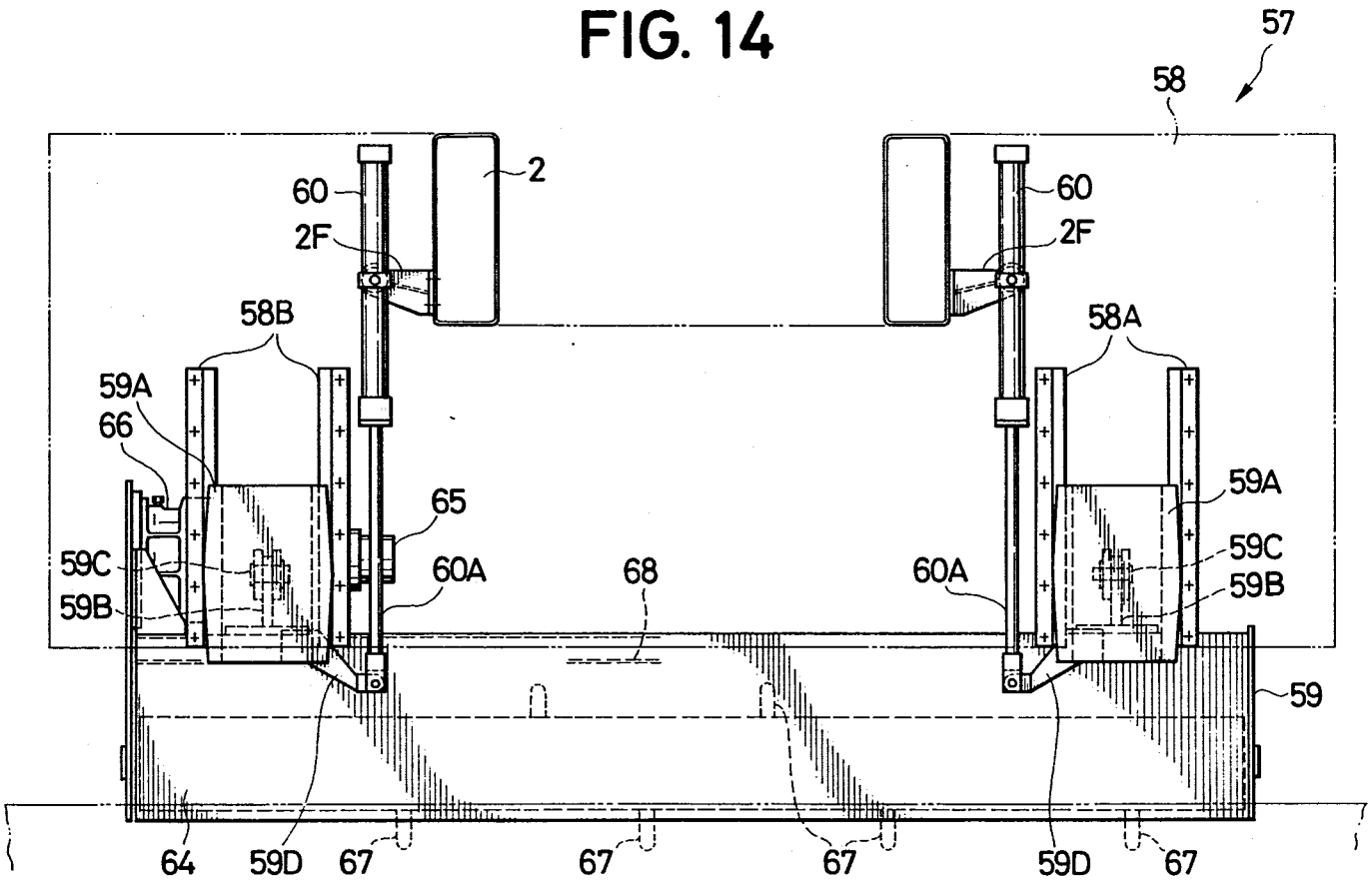
FIG. 14 is a rear view of the second mixer.
Figure 15:
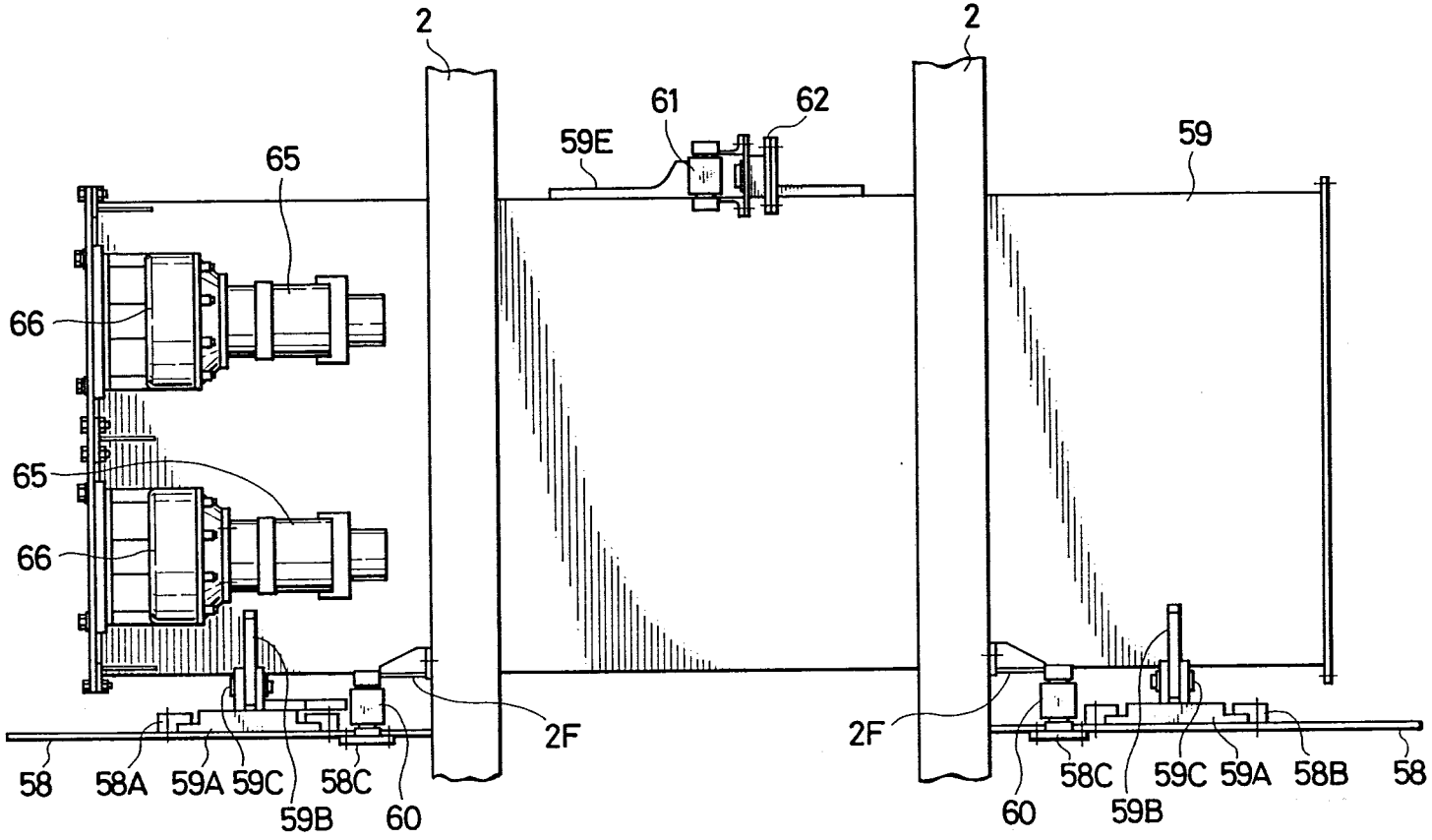
FIG. 15 is a plan view of the second mixer.

The second mixer 57 will now be described with reference to a side view, rear view and plan view thereof which are presented in FIGS. 13, 14 and 15 as well as to a view in FIG. 16 which has been taken from a direction indicated by arrows A—A of FIG. 13.

On the main frame-like body 2 there is vertically provided a mounting plate 58 in such a manner that it intersects the main body 2 at right angles thereto, the mounting plate 58 having a front face, on both lateral end edge portions of which there are respectively provided a pair of guiding means (58A, 58A) and (58B, 58B) in such a manner that those guiding means extend in the vertical direction. Into these guiding means there are vertically movably fitted a pair of guide portions 59A, 59A provided on the rear upper part of a rotor case 59 as later described, respectively, the guide portions 59A, 59A being mounted, by means of shafts 59C, 59C, on mounting portions 59B, 59B provided on the rotor case 59, respectively.

The rotor case 59 is formed into a slender box having an opening at its lower end, the slender-box-like rotor case 59 being disposed beneath the main body 2 in such a manner that it extends in a direction perpendicular to the lengthwise direction of the main body 2. Further, at that position located at the back of the rotor case 59 which is slightly widthwisely outside of the main body 2, there are provided a pair of mounting portions 59D, 59D, to which are connected, respectively, tip ends of piston rods 60A, 60A of raising/lowering cylinders 60, 60. The raising/lowering cylinders 60, 60 are each fixed to the main body 2 and the front upper face of the mounting plate 58, respectively, via fittings 2F and 58C. At the central part of the front face of the rotor case 59 there is provided a mounting portion 59E, to which there are connected, by means of a universal joint, a tip end of a piston rod 61A of a raising/lowering cylinder 61. The raising/lowering cylinder 61 is swingably fixed to the main body 2 by means of a front fitting 62.

Figure 13:
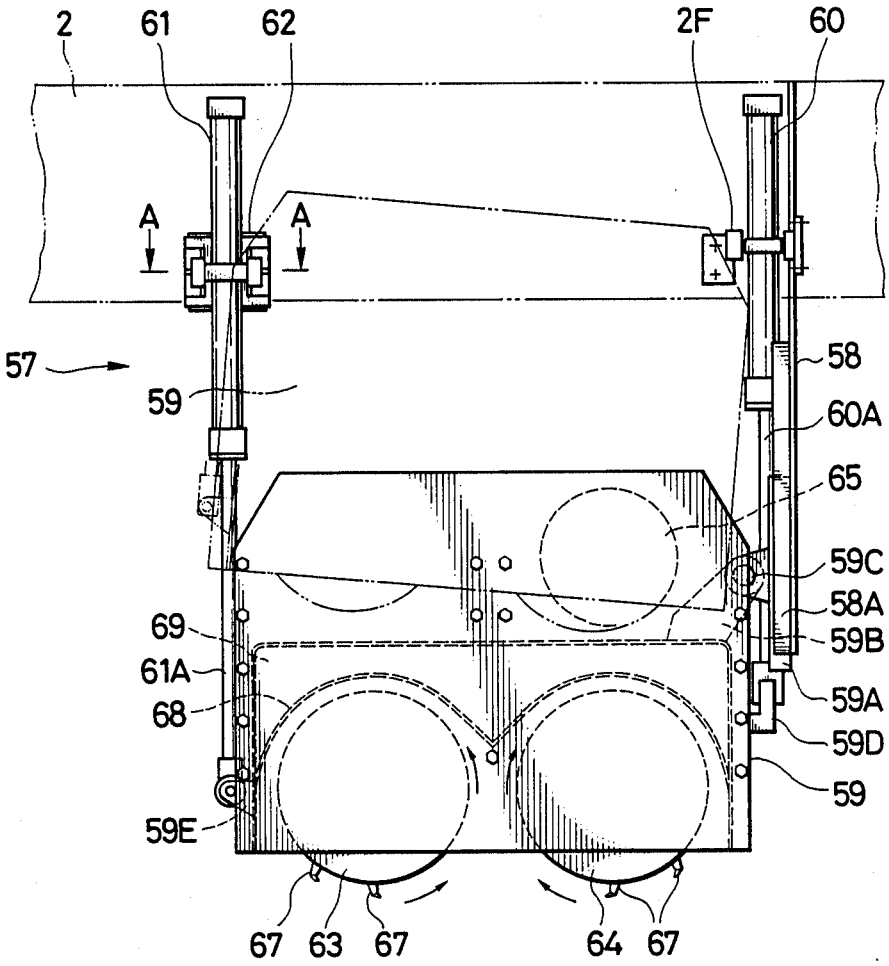
FIG. 13 is a side view of a second mixer.
Figure 16:
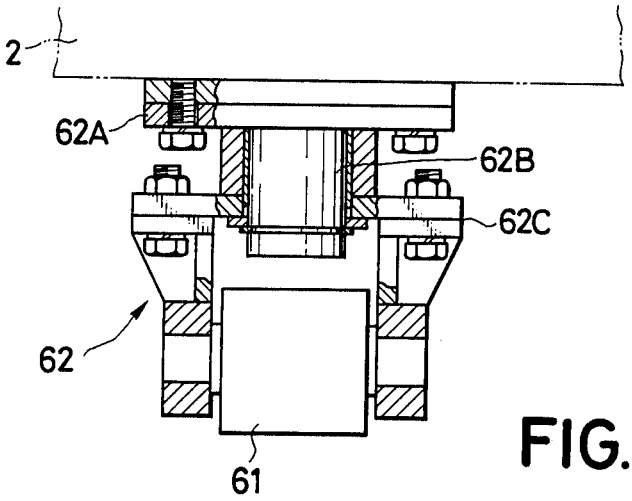
FIG. 16 is a sectional view taken from a direction indicated by arrows A—A of FIG. 13.

As shown in FIG. 16 which is a view of the front fitting 62 as taken from a direction indicated by arrows A, A in FIG. 13, a fixing portion 62A is secured to the side face of the main body 2 perpendicularly with respect thereto, and to this fixing portion 62A is fixed a shaft 62B in such a manner that the latter is horizontally projected from the former, the shaft 62B being fixed thereto with a rotary portion 62C. The rotary portion 62C is bifurcated at its tip end portion and, between respective opposing faces of the bifurcated pieces there is vertically mounted the raising/lowering cylinder 61, whereby a lower portion of the cylinder 61 can be allowed to swing about the shaft 62B in the back-and-forth direction of the main body 2. That is, as shown in FIG. 13 by two-dot and dash lines, when the piston of the front raising/lowering cylinder 61 is more contracted than those of the back raising/lowering cylinders 60, the front portion of the rotor case 59 can be upwardly inclined about the shafts 59C, 59C. While, at this time, the lower portion of the piston rod 61A is frontwardly moved in view of the radius of rotation about the shafts 59C, the subsequent frontward swing of the lower portion of the cylinder 61 is smoothly effected about the shaft 62B. The reason why the raising/-lowering operation for the rotor case 59 is performed as above by use of the three raising/lowering cylinders is to obtain the ease with which the lower end faces of the two-shaft rotors are brought into conformity with the surface involved of the road.

Inside the rotor case 59 there are disposed a pair of parallel rotors 63, 64 in a state wherein they are parallel arranged back and forth while they are kept in their horizontal posture. Located right above the rotors 63, 64 and on one end edge portion of the rotor case 59 are a pair of hydraulic motors 65, 65 having output shafts not shown, tip end portions of which are incorporated into mechanical power-transmission unit 66, 66. The rotors 63, 64 are adapted to be driven by way of these mechanical power-transmission units 66, 66. On the outer peripheral surfaces of the rotors 63, 64 there are mounted a plurality of bits 67, 67, --- at specified intervals. On the other hand, the rotors 63, 64 are made rotatable in opposite directions as indicated in FIG. 13 by arrows. Namely, the front rotor 63 makes its cutting operation from above to below while the back rotor 64 makes its cutting operation from below to above. The two rotors 63, 64 are intended to cause the scarified pavement pieces as mixed together by the rotor 48 of the first mixer 38 to be mixed with the new asphalt mixture material as allowed to drop in immediate front of the second mixer 57. When the amount of the new asphalt mixture material being allowed to drop in immediate front of the second mixer 57 is larger than usually specified (for example, when the level of the road surface is somewhat elevated by addition of a larger amount of the new asphalt mixture material, the front cylinder 61 is caused to make its contracting operation to lift the front part of the rotor case 59 so as to facilitate the performance of the mixing operation.

At the upper inner zone of the rotor case 59 there is disposed a heating plate 68 the cross section of which is shaped like two consecutive circular arcs in conformity with the peripheral surfaces of the rotors 63, 64, the heating plate 68 defining a heating chamber 69 in cooperation with a top wall surface of the rotor case 59. Into the heating chamber 69 there is supplied a hot air from a heater not shown to thereby heat the heating plate 68 up to a temperature of 160° C. or more. Whereby, the new asphalt mixture material having been allowed to drop over the part of the road surface located in immediate front of the rotor case 59 is stirred, scratched upwards and brought into sliding contact with the heating plate 68, under the rotor case 59, by means of the rotors 63, 64. Thus, it is heated by way of heat exchange and is thereby softened, with the result that it comes to have high mixability with, and high adherence to, the scarified pavement pieces.

At the back of the rear wheels 4 there are sequentially disposed from the frontward side toward the backward side of the apparatus, as shown in FIG. 1, a first screw spreader 70, a first screed 71, a second screw spreader 72, and a second screed 73, in the order mentioned, each of which is of a conventional type. A description thereof will therefore be made briefly as follows.

The first screw spreader 70 can be raised and lowered by operation of a raising/lowering cylinder 70A. The screw is made into a construction of extruding or spreading the pieces of the composite material from the longitudinal center toward the ends of its shaft. This is for the purpose of spreading the scarified material pieces, which have been gathered by the first mixer 38 toward the longitudinal center line of the main body, toward the outer side of the running wheels 4, 4 to thereby distribute them equally over the overall width of the road surface to be reproduced. It is to be noted that auxiliary screw spreaders for enlarging the width can be connected to the ends of the main screw spreader 70.

The first screed 71 can be raised, or lowered for pressurization, by operation of a raising/lowering cylinder 71A. The screed 71 contains therein a heater not shown and a vibrator so as not only to heat the upper surface layer involved (the scarified pavement pieces and new asphalt mixture) of the reproducing road but also to vibrate and level the same to a specified uniform thickness.

The second screw spreader 72 is intended to be used for levelling to a specified thickness the new asphalt mixture material allowed to drop over the road surface zone in immediate front of the second screed 73. The positional level of the second screw spreader 72 is adjusted by operation of a raising/lowering cylinder 72A, or the spreader 72 is kept elevated, as the occasion demands, so as to be prevented from hindering the running of the vehicle apparatus. Auxiliary screw spreaders can be added to the ends of the main spreader 72 for the purpose of effecting the enlargement in length of the serial spreader arrangement.

The positional level of the second screed 73 is controlled, or pressurization thereby of the road surface is effected, through operation of a raising/lowering cylinder 73A. The screed 73 is intended to be used for finally levelling the upper face of the road surface layer to flatten the same. It contains therein a heater and vibrator not shown to shape such upper face to make the same flat while heating and vibrating the same.

In FIG. 1, a reference numeral 74 denotes centering plates provided in front of the rear wheels 4, 4, the centering plates being respectively secured to the supporting shafts vertically provided on both sides of the main body 2, the interval between the centering plates being made greater at the frontward part thereof and made smaller at the backward part so as to draw the reproducing material pieces in front of the rear wheels to the central part of the road, to thereby prevent a decrease in propulsive force.of the rear wheels 4, 4. Reference numeral 75 denotes a hood.

A contact piece not shown is mounted on an axle 4A of the rear wheels 4, 4. The rear wheels 4, 4 are supported on a pair of bearings, respectively, on which there is mounted a speed sensor in corresponding relationship to the contact piece, the speed sensor having an electric circuit which is connected to the microcomputer contained in the operation board 9. The rotational speed of the rear wheels is programmed in the microcomputer, whereby the amount of additive being ejected by the additive ejection pump 11D is controlled in corresponding relationship to the speed of the main body 2. Namely, preferably additive is uniformly added or scattered in specified amount over a specified area of the road surface involved. However, when additive is ejected at specified constant rate from the ejection pump 11D, the amount of additive being scattered over the road surface varies with the speed of the vehicle apparatus. As a result, a homogeneous pavement fails to be obtained. In order to maintain the relationship of (the speed x the amount ejected =the amount scattered) to thereby prevent the finished pavement from failing to become homogeneous, the vehicle speed is detected by the speed sensor, whereby the ejecting amount of additive is controlled in accordance with the vehicle speed.

In FIG. 1, in the position which is located in front of the front wheels 3, 3 and at the rear lower side of the mixture hopper 19, a heating panel 76 is suspended, by means of suspending wires 76A, 76B, from the main body 2 and the hopper supporting arms 18. On the hopper supporting arms 18 there is mounted a raising/-lowering means 76C which uses a cylinder, and to which the suspending wire 76B is connected, the wire 76B being guided by means of a sheave 76D. Further, disposed under the main body 2 is another sheave 76E, by means of which the suspending wire 76A is guided, and which is then connected to a raising/lowering means not shown. The positional level of the heating panel 76 as measured from the road surface G is controlled by the raising and lowering operation of the raising/lowering means. In the heating panel 76 there are disposed gas burners not shown to which there are connected gas hoses extending from the gas cylinders 10A, whereby the heating panel can supplementarily heat the road surface layer.

As described above, according to the present invention, the mixture hopper has been constructed so that it can make its rolling operation in the lateral direction of the main body. Therefore, even when the mixture attaches onto the inner wall surface of the mixture hopper to cause creation of cavities at the lower part of the latter with the result that the mixture fails to be constantly discharged from the bar feeder, the outflow of the mixture from the bar feeder can be smoothly effected to make equal or uniform the amount of the asphalt mixture scattered over a specified area of the road surface, by causing rolling of the hopper.

Since the claws of the scarifier can have their vertical position controlled in conformity with irregularities of the road surface, they can scarify the road surface to the same depth in a manner to follow up the irregular road surface. This can make the reproduction layer of the road surface homogeneous.

As for the mixers, those scarified pavement pieces of the road surface involved which have been produced as a result of scarification made by the scarifier are cut or broken into finer pieces, at the same time are mixed with additive, and the resulting pieces are drawn toward the central part of the road, by the first mixer. The second mixer effects a mixing, by its twin-shaft mixing system, of the road surface pavement pieces (which are added, if necessary, with new asphalt mixture) having been drawn as above, the twin-shaft mixing system having a front rotor based on the down-cut system and a back rotor based on the up-cut system. Therefore, it can effect a sufficient mixing or kneading of the material involved even when deep scarification is made.

The additive ejection pump according to the present invention can have its rate of ejection controlled in accordance with the speed of the vehicle body. Therefore, even when the running speed of the vehicle body is increased or decreased in corresponding relationship to the conditions of a road involved, it is possible to cause a specified amount of additive to be equally or uniformly scattered over a specified area of the road surface to be remedied. This makes it possible to obtain a homogeneous reproduction layer of the road surface.

As has been described above, the present invention has the following excellent effects in addition to the effects generally obtainable with a conventional apparatus of this type.

(1) In the process step for permitting new asphalt mixture to be scattered in specified amount by use of the bar feeder operated with a specified speed, the mixture hopper can be laterally vibrated to thereby permit the mixture material to be smoothly dropped onto the bar feeder. This enables a specified amount of the mixture to be equally or uniformly scattered over a specified area of the road surface.

(2) Since the claws of the scarifier can be vertically moved in their vertically erected posture so as to permit their lower ends to be in conformity with the condition of a road surface to be remedied, it is possible to scarify to the same depth even the irregular road surfaces which are attributable to, for example, the rutting, whereby reprcduction of the road surface can be effected with a uniform thickness.

(3) Since the mixer is of multi-shaft rotor system, mutual mixing of the pavement pieces can be finely effected to a sufficient extent even in the case of deep scarification or of overlaying remedy. This can improve the homogenizability.

What is claimed is:

1. A road surface layer reproducing apparatus in the form of an automotive vehicle, comprising an automotive main frame-like body, a mixture hopper at a front side of said main body, and a scarifier and a mixers at positions beneath said main body, said mixture hopper being supported by a hopper supporting shaft laid on said main body in the longitudinal direction thereof while the hopper supporting shaft is kept horizontal, and said mixture hopper being laterally swingable in a plane perpendicular to said longitudinal direction about said hopper supporting shaft, said scarifier having claws mounted thereon via fittings, and being disposed in a vertical posture in a state wherein each fitting has a pin idly inserted into a pin hole formed in an upper end portion of the corresponding claw, and wherein means are provided for vertically moving said fittings so that lower ends of said claws may follow up the contour of a road to be reproduced, said mixers including a first and a second mixer which are disposed in such a manner as to intersect the advancing direction of said main body at right angles thereto, said first mixture being constructed in the form of a single-shaft rotor and being arranged such that its depth of penetration into a previous pavement of said road is adjusted to a predetermined value by a depth measuring device for sensing a surface of said pavement and thereby controlling said depth of penetration, said first mixer moving a mixture toward a position corresponding to a central part of said main body by means of rotor bits mounted to an outer peripheral surface of said rotor, to thereby form a windrow of said mixture over which is dropped a bituminous mixture having been transferred rearwardly of said main body from said hopper by way of a bar feeder, said second mixer being located at a position succeeding to said first mixer and being constructed in the form of a parallel mounted twin-rotor system and made vertically movable by a three-point supporting mechanism, said second mixer being adapted to mix together said windrow and said bituminous mixture as dropped thereover.

* * * * *

UNITED STATES PATENT AND TRADEMARK OFFICE

CERTIFICATE OF CORRECTION

PATENT NO. : 4,780,022

DATED : October 25, 1988

INVENTOR(S) : Tatushiko CHIBA, Ken-ichi IGARASHI

It is certified that error appears in the above-identified patent and that said Letters Patent is hereby corrected as shown below:

Title page: column 1, line [75] please correct the spelling of the Surname to --CHIBA--.

Signed and Sealed this

Seventh Day of March, 1989

*Attest:*

DONALD J. QUIGG

*Attesting Officer*

*Commissioner of Patents and Trademarks*